US006849586B2

(12) United States Patent
Avery et al.

(10) Patent No.: US 6,849,586 B2
(45) Date of Patent: Feb. 1, 2005

(54) HARD SURFACE CLEANERS CONTAINING CHITOSAN

(75) Inventors: Richard W. Avery, High Wycombe (GB); Ian Robb, Stevens County, OK (US)

(73) Assignee: S. C. Johnson & Son, Inc., Racine, WI (US)

( * ) Notice: Subject to any disclaimer, the term of this patent is extended or adjusted under 35 U.S.C. 154(b) by 104 days.

(21) Appl. No.: 10/035,499

(22) Filed: Oct. 26, 2001

(65) Prior Publication Data

US 2003/0092597 A1 May 15, 2003

(51) Int. Cl.[7] ..... C11D 1/66; C11D 3/16; C11D 3/30; C11D 3/26

(52) U.S. Cl. ..... 510/191; 510/238; 510/421; 510/422; 510/433; 510/434; 510/471; 510/477; 510/488; 510/499; 510/504

(58) Field of Search ..... 510/191, 238, 510/421, 422, 433, 434, 471, 477, 488, 499, 504

(56) References Cited

U.S. PATENT DOCUMENTS

| | | | | |
|---|---|---|---|---|
| 4,011,169 A | | 3/1977 | Diehl et al. | |
| 4,289,642 A | | 9/1981 | Weber et al. | |
| 4,528,283 A | | 7/1985 | Lang et al. | 514/55 |
| 4,765,976 A | | 8/1988 | Grollier et al. | 424/70 |
| 4,780,310 A | | 10/1988 | Lang et al. | 424/47 |
| 4,931,271 A | | 6/1990 | Lang et al. | |
| 4,957,908 A | | 9/1990 | Nelson | |
| 4,976,952 A | | 12/1990 | Lang et al. | |
| 5,008,108 A | | 4/1991 | Rha et al. | |
| 5,061,393 A | | 10/1991 | Linares et al. | |
| 5,182,105 A | | 1/1993 | Takata et al. | |
| 5,358,656 A | | 10/1994 | Humphreys et al. | |
| 5,397,384 A | | 3/1995 | Wisniewski | |
| 5,405,878 A | | 4/1995 | Ellis et al. | |
| 5,447,643 A | | 9/1995 | Kelkenberg et al. | |
| 5,512,199 A | | 4/1996 | Khan et al. | |
| 5,541,233 A | | 7/1996 | Roenigk | |
| 5,571,458 A | | 11/1996 | Beauquey et al. | |
| 5,609,168 A | | 3/1997 | Kischka et al. | |
| 5,648,328 A | | 7/1997 | Angell et al. | |
| 5,661,118 A | | 8/1997 | Cauwet et al. | |
| 5,731,025 A | | 3/1998 | Mitchell | |
| 5,747,014 A | | 5/1998 | Cauwet et al. | |
| 5,776,876 A | * | 7/1998 | Garris | 510/247 |
| 5,786,468 A | | 7/1998 | Au et al. | |
| 5,851,980 A | | 12/1998 | Avery | |
| 5,879,669 A | | 3/1999 | Clausen et al. | |
| 5,891,861 A | | 4/1999 | Platt | |
| 5,968,485 A | * | 10/1999 | Robinson | 424/59 |
| 5,976,517 A | | 11/1999 | Dubief et al. | |
| 6,022,549 A | | 2/2000 | Dyer | |
| 6,042,877 A | | 3/2000 | Lyon et al. | |
| 6,068,835 A | * | 5/2000 | Franzke et al. | 424/70.11 |
| 6,162,423 A | * | 12/2000 | Sebag et al. | 424/70.12 |
| 6,362,142 B1 | * | 3/2002 | Weber et al. | 510/119 |
| 6,387,855 B1 | * | 5/2002 | De La Mettrie | 510/122 |
| 6,432,892 B2 | * | 8/2002 | Meine et al. | 510/111 |

FOREIGN PATENT DOCUMENTS

| | | | |
|---|---|---|---|
| EP | 0585885 | 3/1994 | C08B/37/08 |
| EP | 1190702 A1 | 3/2002 | A61K/7/48 |
| WO | WO 99/03959 | 1/1999 | C11D/1/62 |
| WO | WO 00/32733 | 6/2000 | C11D/3/395 |
| WO | WO 01/42415 A1 | 6/2001 | C11D/3/37 |

OTHER PUBLICATIONS

Henkel advertising literature entitled "From The Depths Of The Sea" undated.

* cited by examiner

*Primary Examiner*—Gregory P. Del Cotto

(57) ABSTRACT

Disclosed herein are acidic aqueous hard surface cleaners and methods for using them. The cleaners include a surfactant and a poly D-glucosamine such as chitosan. They provides residual benefits on the hard surface such as soil resistance and resistance to bacteria, molds and biofilms.

4 Claims, 1 Drawing Sheet

HARD SURFACE CLEANERS CONTAINING CHITOSAN

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to cleaning compositions for hard surfaces. They appear to be especially well suited for use in cleaning toilets, baths, shower surrounds and other plumbing fixtures, bathroom and kitchen hard surfaces, drains and floor surfaces.

The art has developed a variety of hard surface cleaning compositions, including some which are acidic. For example, U.S. Pat. No. 5,008,030 discloses cleaning compositions that contain nonionic surfactants, a monocarboxylic acid, water, and other additives. The disclosure of this patent and of all other patents described herein are incorporated by reference as if fully set forth herein. Also, U.S. Pat. No. 5,061,393 teaches a hard surface cleaner that is a mixture of a zwitterionic surfactant, nonionic surfactant, citric acid, and various other components, and U.S. Pat. No. 5,851,980 teaches aqueous acidic liquid hard surface cleaners having nonionic surfactants, glycolic and lactic acids, N-alkyldimethyl benzyl ammonium chloride, and fragrance. Ether solvents are also taught in the last of these patents.

U.S. Pat. No. 5,061,397 also teaches hard surface cleaners with butyl cellosolve, citric acid, and colorants. Other publications describe the use of sulfamic acid, amine oxides and cellulosic thickeners and hard surface cleaners.

While these varied prior art hard surface cleaners have provided a variety of ways to clean hard surfaces, they have been limited in their ability to provide residual benefits to the surfaces being cleaned. In this regard, it is desirable to render hard surfaces that are being cleaned more resistant to becoming soiled, and to provide the surface with antimicrobial characteristics.

Chitosan is a poly D-glucosamine that has been isolated from the shells of crabs, lobsters or shrimps, or derived from chitin. Chitosan has previously been added to certain skin and hair care products, including some that contain surfactants and water. In these applications chitosan is used for its protective effects. Examples of such products include hair setting preparations, hair gels, hair mousses, styling creams, anti-dandruff preparations, hair tonics, hair rinses, skin moisturizers, deodorants and antiperspirants. See also U.S. Pat. No. 4,931,271 which describes certain problems in using chitosan in shampoos with anionic surfactants.

Chitosan has also been used in a number of other contexts. For example, U.S. Pat. No. 5,541,223 teaches that chitosan can be included in a sponge. However, Applicants believe that the art had not previously included chitosan in a hard surface cleaner.

Thus, there is a continuing need to develop hard surface cleaners which not only are effective in cleaning at the time of use, but also provide positive residual benefits to the surface that has been cleaned.

BRIEF SUMMARY OF THE INVENTION

In one aspect the invention provides a hard surface cleaner having a pH below 7.0, one or more surfactants (preferably in the 0.1–10% weight range), a poly D-glucosamine (preferably at less than 2% by weight), and water. The preferred poly D-glucosamine is chitosan.

Normally more than 50% of the cleaner should be water (preferably over 90% of the cleaner), and there is preferably also an acid.

A wide variety of surfactants are suitable such as those that are nonionic, anionic, cationic and amphoteric, and mixtures thereof. However, for many applications a nonionic surfactant such as Glucopon 425 N is particularly preferred. Examples of such surfactants are described in McCutcheon's: Emulsifiers & Detergents, North American Edition (1995).

Suitable other nonionic surfactants include alkyl amine oxides (e.g. $C_{8-20}$ alkyl dimethyl amine oxides), alkylphenol ethoxylates, linear and branched alcohol ethoxylates, carboxylic acid esters, alkanolamides, alkylpolyglycosides, ethylene oxide/propylene oxide copolymers, linear and secondary alcohol ethoxylates, octyl- and nonyl-phenol ethoxylates, alkanol amides and alkylpolyglycosides.

Useful zwitterionic/amphoteric surfactants include alkyl aminopropionic acids, alkyl iminopropionic acids, imidiazoline carboxylates, alkylbetaines, sulfobetaines, and sultaines.

Useful cationic surfactants include, for example, primary amine salts, diamine salts, quaternary ammonium salts, and ethoxylated amines.

Useful anionic surfactants (which are preferably used only in conjunction with a nonionic surfactant, if at all) include carboxylic acid salts, alkyl benzene sulfonates, secondary n-alkane sulfonates, alpha-olefin sulfonates, dialkyl diphenylene oxide sulfonates, sulfosuccinate esters, isoethionates, linear alcohol sulfates (alkyl sulfates), and linear alcohol ethoxy sulfates.

The poly D-glucosamine is preferably a chitosan (such as that available from Henkel/Cognis under the trade name Hydagen NH). Coarse grades are alternatively available by being ground from crab shells. More pure forms can be obtained by deacetylation of chitin. Other poly D- glucosamines are nitrogen or other salts of chitosan.

The acid is preferably less than 10% of the cleaner, even more preferably less than 5% of the cleaner. Preferred acids are organic acids such as lactic acid, sulfamic acid, citric acid, valeric acid, hexanoic acid, and glycolic acid. Other examples are formic acid, acetic acid, propionic acid, butyric acid, and gluconic acid, and peroxy variants of these acids such as peroxyacetic acid. In order to optimize the effectiveness of chitosan the pH should be below 7.0, preferably below 5.0, and even more preferably between 2 and 5. This can be achieved by appropriate use of acids to remove limescale (e.g. in a toilet bowl cleaner), with a modifying base such as sodium hydroxide to fine-tune the pH if needed.

There may also be a glycol ether solvent (most preferably ethylene glycol hexyl ether or ethylene glycol butyl ether). This is particularly desirable for kitchen cleaners where there is substantial grease that needs to be cleaned. Other possible solvents are terpenes, aliphatic hydrocarbons and alpha-olefins, and organic compounds containing at least one oxygen atom, such as alcohols and ethers.

Among these oxygen-containing solvents are aliphatic alcohols of up to 8 carbon atoms, particularly tertiary alcohols of up to 8 carbon atoms; aromatic-substituted alcohols; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbons atoms in each alkyl group; mono- or diesters of alkylene glycols or polyalkylene glycols having up to 6 carbon atoms per glycol group and up to 6 carbon atoms in each ester group.

Specific examples of solvents include t-butanol, t-pentyl alcohol, 2,3-dimethyl-2-butanol, benzyl alcohol or 2-phenyl ethanol, ethylene glycol, propylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, diethylene glycol monomethyl ether, dipropylene glycol monomethyl ether, triethylene glycol, propylene glycol monoacetate, and dipropylene glycol monoacetate.

The solvent preferably constitutes no more than 6 weight percent of the composition, more preferably no more than 2 weight percent.

For some applications such as toilet cleaners and bathroom cleaners it may be desirable that the cleaner also contain a cellulosic thickener. A preferred thickener is hydroxyethyl cellulose.

If desired a disinfectant can be used (preferably benzalkonium chloride). Other possible disinfectants include polyhexamethylene biguanide, phenolic disinfectants, amphoteric disinfectants, anionic disinfectants, and metallic disinfectants (e.g. silver).

In another form, the invention provides a method of cleaning a hard surface. One applies a cleaner of the above kind against the hard surface (e.g. by rubbing), then rinses the surface with water.

By "hard surface" we mean a solid, substantially non-flexible, surface such as a counter top, bathroom tile, plumbing fixture wall, bathroom or kitchen wall, or linoleum floor. It does not include fabric, carpet, hair, skin, or other materials which are highly flexible.

It has been surprisingly learned that the addition of poly D-glucosamines (particularly chitosan) to a hard surface cleaner (particularly an acidic hard surface cleaner containing a nonionic surfactant) causes surfaces that have been cleaned using the cleaner to be left with residual benefits. In particular, the surfaces resist staining, are easier to clean when stained, and provide resistance to bacteria, molds and biofilms. These benefits have been achieved without disrupting the cleaning function of the cleaner.

Chitosan is a naturally occurring material which can be obtained at relatively low cost. It is non-toxic, biodegradable and is a renewable resource.

The foregoing and other advantages of the invention will appear from the following description. In that description reference is made to the accompanying drawing which forms a part hereof. These embodiments do not represent the full scope of the invention. Thus, the claims should be looked to in order to judge the full scope of the invention.

DETAILED DESCRIPTION OF THE PREFERRED EMBODIMENTS

Figure 1:
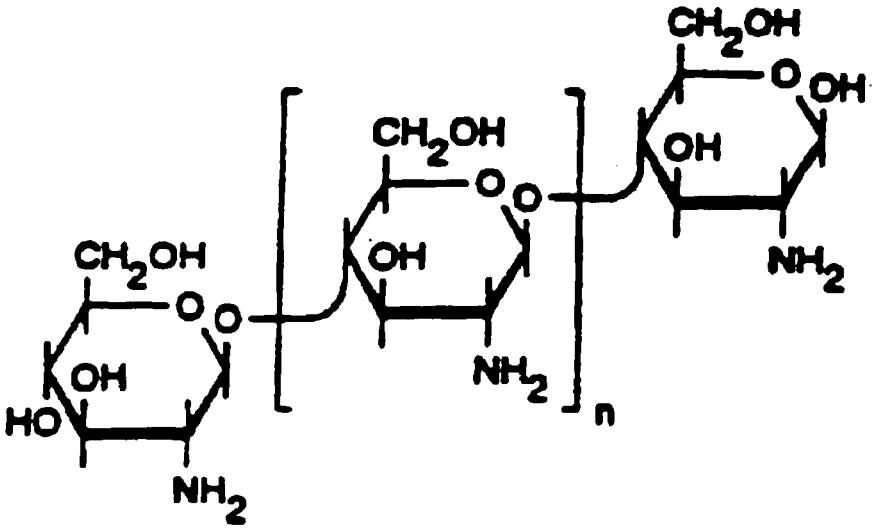
FIG. 1 is a general chemical formula for chitosan (n being variable based on the source of chitosan).

Preferred examples of the present invention are described below. They are two toilet bowl cleaners, a bath and shower cleaner, and a kitchen cleaner.

EXAMPLE 1

Toilet Bowl Cleaner

| Weight percent | Description |
|---|---|
| to 100 | water |
| 2.00 | ethoxylated alcohol |
| 2.50 | glycolic acid |
| 0.25 | chitosan |
| 0.50 | benzalkonium chloride |

EXAMPLE 2

Toilet Bowl Cleaner

| Weight percent | Description |
|---|---|
| to 100 | water |
| 2.00 | ethoxylated alcohol |
| .50 | sulfamic acid |
| 2.50 | glycolic acid |
| 0.25 | chitosan |
| 0.50 | benzalkonium chloride |

EXAMPLE 3

Bath and Shower

| Weight percent | Description |
|---|---|
| to 100 | water |
| 1.00 | polyglucoside surfactant |
| .50 | citric acid |
| .50 | lactic acid |
| 0.25 | chitosan |
| 0.20 | benzalkonium chloride |

EXAMPLE 4

Kitchen Cleaner

| Weight percent | Description |
|---|---|
| to 100 | water |
| .30 | Amine oxide surfactant |
| .75 | Polyglucoside surfactant |
| 1.00 | citric acid |
| .43 | ethylene glycol hexyl ether |
| .57 | ethylene glycol butyl ether |
| 0.25 | chitosan |
| 0.01 | benzalkonium chloride |

Method of Forming Preferred Embodiments

The above cleaners can be formulated by adding the components to water and then mixing at room temperature. Where an anionic surfactant is to be added, it is preferable to first add the nonionic surfactant and chitosan (as anionic surfactants alone may cause instability for the chitosan).

Testing

We tested two formulations: (P-65-3) which contained water, acid, chitosan, and Glucopon 425 N within the claim scope; and (P-65-1) which contained water and acid but not the chitosan or Glucopon 425 N. The latter was the control. We basically treated a surface individually with each test formula. We then exposed the surface to *S. aureus* with 5% fetal bovine and observed bacteria levels after a defined test period.

The control water and acid formulation averaged 94.22687% reduction in bacteria, whereas the P-65-3 formula led to a average reduction of 99.95456%. Thus, the addition of the chitosan in the nonionic formulation provided marked antimicrobial effects that were residual in nature.

Thus, the present invention provides effective cleaners that not only clean hard surfaces, but also leave desirable residual properties on those surfaces after the cleaning. While the preferred embodiments incorporate chitosan, other poly D-glucosamines (e.g. substituted chitosans) can be used, or mixtures of chitosan with chitosan variants can be used.

While specific embodiments have been described, various modifications falling within the breadth and scope of the invention. The following claims should be looked to in order to understand the full scope of the invention.

INDUSTRIAL APPLICABILITY

The present invention provides improved hard surface cleaners.

We claim:

1. A hard surface cleaner having a pH below 7.0, comprising:

a surfactant;

a poly D-glucosamine which is selected from the group consisting of chitosan itself and salts of chitosan itself, said poly D-glucosamine being present in an amount effective to facilitate antimicrobial activity of the cleaner;

an acid;

a disinfectant;

a glycol ether solvent;

a cellulosic thickener; and water;

wherein the hard surface cleaner is capable of causing a surface that has been cleaned with the cleaner to inhibit bacterial growth on the surface after the cleaning.

2. The hard surface cleaner of claim 1, wherein the acid is an organic acid selected from the group consisting of lactic acid, sulfamic acid, citric acid, valeric acid, hexanoic acid, and glycolic acid.

3. The hard surface cleaner of claim 1, wherein the surfactant is a nonionic surfactant in the 0.1–10% weight range.

4. The hard surface cleaner of claim 1, wherein the water is at least 50% by weight of the cleaner.

* * * * *